US007533618B2

(12) United States Patent
Thomason

(10) Patent No.: US 7,533,618 B2
(45) Date of Patent: May 19, 2009

(54) WALL TABLE DEVICE AND METHOD THEREFOR

(76) Inventor: Ron Thomason, 2749 Carolina Blue Ave., Henderson, NV (US) 89052

( * ) Notice: Subject to any disclaimer, the term of this patent is extended or adjusted under 35 U.S.C. 154(b) by 570 days.

(21) Appl. No.: 11/140,169

(22) Filed: May 31, 2005

(65) Prior Publication Data

US 2006/0265984 A1 Nov. 30, 2006

(51) Int. Cl.
*A47B 37/00* (2006.01)

(52) U.S. Cl. ..... 108/42; 108/47; 52/35

(58) Field of Classification Search ..... 108/42, 108/44, 46–48; 14/69.5; 52/27, 27.5, 28, 52/31, 34, 35, 36.2, 38, 741.1
See application file for complete search history.

(56) References Cited

U.S. PATENT DOCUMENTS

| | | | | | |
|---|---|---|---|---|---|
| 1,222,053 | A * | 4/1917 | Watson | 248/237 |
| 1,770,955 | A * | 7/1930 | Storm | 108/8 |
| 2,045,965 | A * | 6/1936 | Rosen | 4/654 |
| 2,131,214 | A * | 9/1938 | Bentz | 4/576.1 |
| 2,721,777 | A * | 10/1955 | Willis | 108/44 |
| 2,834,968 | A * | 5/1958 | Hefley | 4/560.1 |
| 3,875,597 | A * | 4/1975 | McGaffin et al. | 4/578.1 |
| D252,239 | S * | 7/1979 | Smith | D6/355 |
| 4,993,088 | A * | 2/1991 | Chudik | 5/118 |
| 4,995,322 | A * | 2/1991 | Frederick | 108/44 |
| 5,584,253 | A * | 12/1996 | Stranford | 108/42 |
| 5,660,117 | A * | 8/1997 | Noble | 108/35 |
| 5,730,066 | A * | 3/1998 | Auten et al. | 108/44 |
| 5,842,423 | A * | 12/1998 | Stranford | 108/42 |
| 5,960,904 | A * | 10/1999 | Ullmann | 182/45 |
| 6,161,486 | A * | 12/2000 | Boots | 108/48 |
| 6,269,905 | B1 * | 8/2001 | Smith | 182/45 |
| 6,289,824 | B1 * | 9/2001 | Parker et al. | 108/115 |
| 6,643,879 | B1 * | 11/2003 | Davis | 14/69.5 |

* cited by examiner

*Primary Examiner*—Richard E Chilcot, Jr.
*Assistant Examiner*—Chi Q Nguyen
(74) *Attorney, Agent, or Firm*—Veronica-Adele R. Cao; Weiss & Moy, P.C.

(57) ABSTRACT

A wall table device includes a platform for supporting items atop a wall coupled to two stabilizing members extending downward on either side of the wall. The stabilizing members may be positioned to accommodate walls of varying thicknesses.

20 Claims, 2 Drawing Sheets

WALL TABLE DEVICE AND METHOD THEREFOR

BACKGROUND OF THE INVENTION

1. Field of the Invention

The present invention relates generally to tables, and more specifically, to a device and method for providing a table surface atop a wall.

2. Background of the Invention

Balconies typically are enclosed by a low wall for is safety and privacy and often tend to be small. Although small, balconies frequently tend to be used as a gathering place during social events. Access to sunshine, fresh air, and providing a location for outdoor grilling are just a few of the many features offered by balconies.

Commonly, balconies do not provide enough space to allow people to entertain as effectively as they desire. An outdoor grill, several chairs, and a few friends will often fill a balcony to capacity, leaving no room for a table to position food, beverages, and the like.

As a result, often people will use the top surface of the balcony wall to support items. The wall top offers support at both a convenient height and location for either standing or sitting. Use of the wall top in this manner effectively increases usable balcony space. Unfortunately, balcony walls tend to be relatively narrow, and positioning of items such as beverages or plates balanced atop the wall is often precarious, posing a real danger to passerbys and property beneath the balcony.

A safer option for supporting items is to simply place a table on the balcony. Although providing a secure support surface and eliminating the danger of objects falling off the wall, tables clutter and reduce the usable balcony space that might otherwise be enjoyed by guests.

Therefore, it would be desirable to provide a table device and method that provides all of the benefits presented above with none of the drawbacks.

SUMMARY OF THE INVENTION

It is an object of the present invention to provide a table device securely positionable atop a wall.

It is another object of the present invention to provide a table device that is securely positionable atop walls of varying thicknesses.

The above objectives are achieved in a wall table device and method therefor.

BRIEF DESCRIPTION OF THE PREFERRED EMBODIMENTS

In accordance with one embodiment of the present invention, a device for providing a support surface atop a wall is disclosed. It includes a platform having a top surface and a bottom surface, a first stabilizing member rigidly attached to the bottom surface of the platform, and a second stabilizing member rigidly attached to the bottom surface of the platform. The first stabilizing member and the second stabilizing member constrain a movement of the platform when the platform is positioned atop a wall with the first stabilizing member proximate a first side of the wall and the second stabilizing member proximate a second side of the wall.

In accordance with another embodiment of the present invention, a method for providing a support surface atop a wall is disclosed. It includes the steps of providing a first stabilizing member, providing a second stabilizing member, providing a plurality of threaded fasteners, and providing a platform having a top surface and a bottom surface and defining a plurality of bores extending between the top surface of the platform and the bottom surface of the platform. The method also includes the steps of inserting at least one of the plurality of threaded fasteners through the first stabilizing member and through at least one of the plurality of bores to couple the first stabilizing member to the bottom surface of the platform, aligning the second stabilizing member with at least two of the plurality of bores so that the first stabilizing member being positioned a predetermined distance from the second stabilizing member, attaching the second stabilizing member to the bottom surface of the platform by inserting threaded fasteners through the bores being aligned with the second stabilizing member and into the second stabilizing member, and positioning the platform atop a wall so that the first stabilizing member being proximate a first side of the wall and the second stabilizing member being proximate a second side of the wall.

The foregoing and other objectives, features, and advantages of the invention will be apparent from the following, more particular, description of the preferred embodiment of the invention, as illustrated in the accompanying drawings.

DETAILED DESCRIPTION OF THE PREFERRED EMBODIMENTS

Figure 1:
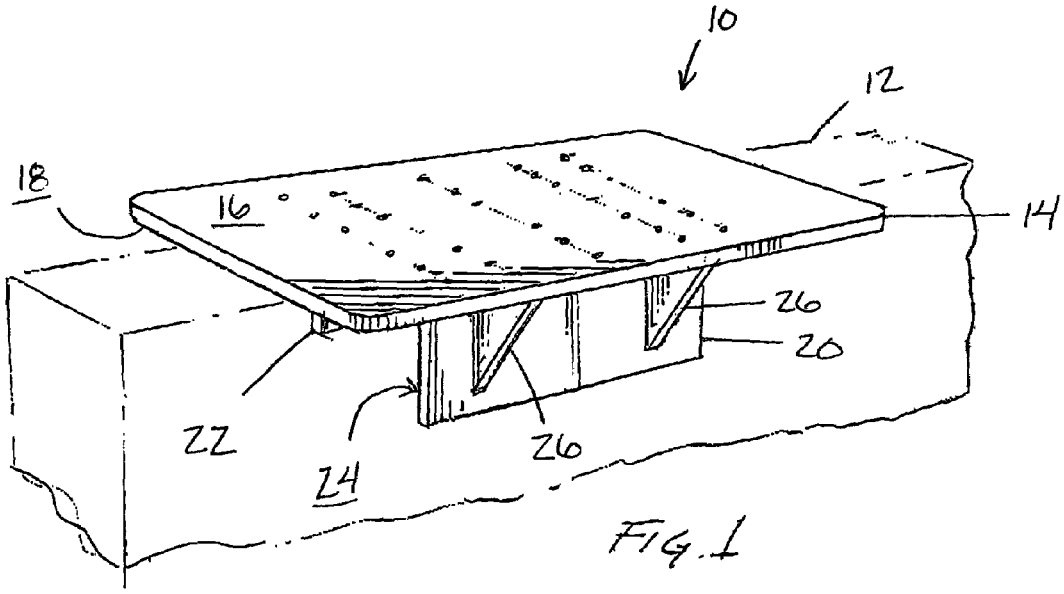
FIG. 1 is a perspective view of a wall table device in accordance with an embodiment of the present invention.

Referring now to the figures and in particular to FIG. 1, a wall table device 10 is depicted in accordance with an embodiment of the present invention. As depicted in FIG. 1, device 10 provides a support surface atop a wall 12. Device 10 has a platform 14 having a top surface 16 and a bottom surface 18. A first stabilizing member 20 is rigidly attached to bottom surface 18 of platform 14. A second stabilizing member 22 is rigidly attached to bottom surface 18 of platform 14. Members 20 and 22 constrain a movement of platform 14 atop wall 12 when platform 14 is positioned so that member 20 is proximate a first side of wall 12 and member 22 is proximate a second side of wall 12.

Positioning device 10 atop a wall provides a stable surface for supporting items. For example, when used on a balcony wall, device 12 effectively increases the useable area of the balcony by extending over and outward beyond wall 12. In addition, items placed on device 12 are more secure than items balanced solely on the top of wall 12. However, it should be clearly understood that device 10 need not be used for balconies, and instead may be used for any purpose requiring a support surface atop a wall. For example, device 10 may provide a stable surface to assist in construction, masonry, painting, or the like.

In the embodiment depicted in FIG. 1, top surface 16 of platform 14 is substantially planar for providing a flat support surface. However, it is within the spirit and scope of the present invention that top surface 16 not be substantially planar, as long as device 10 is capable of supporting items. For example, platform 14 may define one or more recesses, partitions, compartments, raised edges, or the like (not shown) to secure, separate, or organize items supported by device 10.

Figure 3:
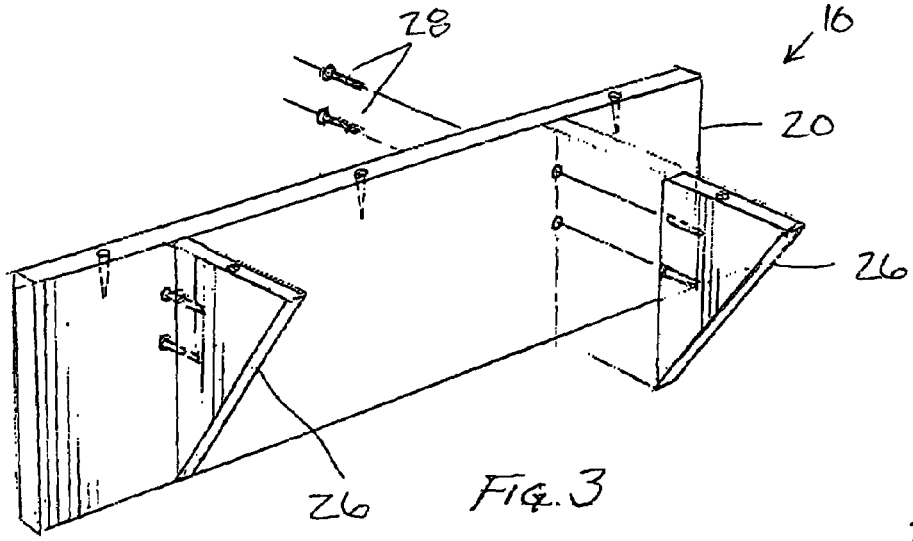
FIG. 3 is a partially exploded perspective view of a wall table device showing attachment of braces to a support member in accordance with an embodiment of the present invention.

Members 20 and 22 are depicted in FIGS. 1 and 3 as having substantially planar portion 24 for contacting a side of wall 12. By having planar portions 24 on either side of wall 12 device 10 is prevented from falling off wall 12 due to an unbalanced load upon surface 16. It is not necessary that members 20 and 22 maintain continual contact with wall 12, as long as members 20 and 22 are sufficiently close to wall 12 to establish contact before device 10 becomes unstable. It should be clearly understood, however, that one or both members 20 and 22 need not have planar portion 24, as long as members 20 and 22 constrain a movement of device 10 from on top of wall 12. For example, members 20 and 22 may comprise a single leg extending downward, an angled rod, a pincer or clamp, or the like.

Figure 5:
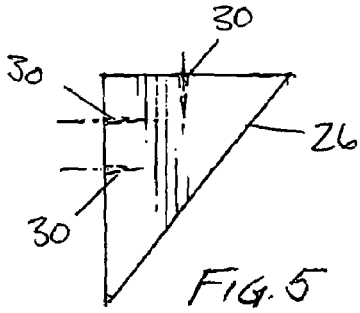
FIG. 5 is a side view of a brace of a wall table device in accordance with an embodiment of the present invention.

Preferably, braces 26 are attached to bottom surface 18 of platform 14 and to members 20 and 22 to rigidly hold members 20 and 22 in place. FIG. 3 depicts an embodiment of the present invention showing the attachment of braces 26 to member 20 by inserting threaded fasteners 28 through bores 30 defined by member 20 and into brace 26. FIG. 5 depicts a side view of brace 26 defining two bores 30 for attaching brace 26 to member 20 and one bore 30 for attaching brace 26 to platform 14 with threaded fasteners 28.

Although braces 26 are depicted as attached to members 20 and 22 and also to platform 14 via threaded fasteners, it should be clearly understood that it is within the spirit and scope of the present invention that braces 26 instead be attached instead with nails, clamps, adhesives, magnetics, hook and loop material, or the like, or any combination thereof, as long as brace 26 remains rigidly attached. Furthermore, although the illustrations depict two braces 26 for each member 20 and 22 providing additional strength to device 10, it is within the spirit and scope of the present invention that device 10 not have two braces 26 for each member, or not have any braces 26 at all, as long as members 20 and 22 are attached to platform 14 with sufficient strength to support a desired load.

Figure 2:
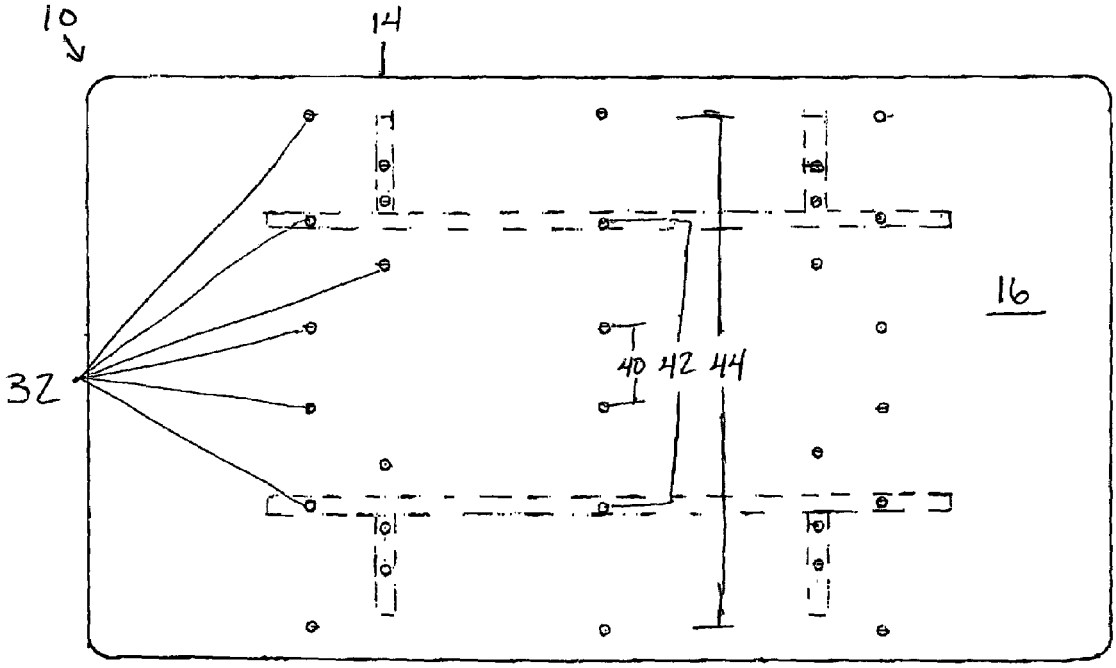
FIG. 2 is a top view of a wall table device showing a plurality of bores as well as stabilizing members and braces in dashed lines in accordance with an embodiment of the present invention.
Figure 4:
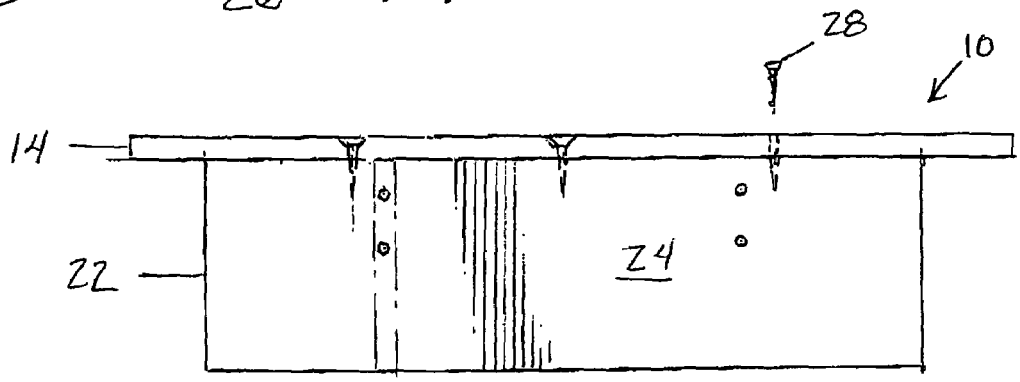
FIG. 4 is a side view of a wall table device in accordance with an embodiment of the present invention.

Turning now to FIG. 2, platform 14 defines bores 32 extending between top surface 16 and bottom surface 18. Bores 32 are dimensioned so that threaded fasteners 28 (see FIG. 4) may be inserted through bores 32 to couple members 20 and 22 as well as braces 26 to platform 14. In the embodiment depicted in FIG. 2, bores 32 are positioned to permit coupling members 20 and 22 so that member 20 is separated at one of a first predetermined distance 40, a second predetermined distance 42, and a third predetermined distance 44 from member 22. In addition, bores 32 are positioned for coupling braces 36 to platform 14 when members 20 and 22 are separated at any of first distance 40, second distance 42, and third distance 44.

The positioning of bores 32 allowing members 20 and 22 to be substantially symmetrically separated at any of distances 40, 42, and 44 permits device 10 to be adjusted for multiple wall widths. It has been determined that distances of approximately 2.75", 7.25", and 9.25" allow device 10 to be used on a majority of walls 12 of standard construction. In addition, although a symmetric positioning of members 20 and 22 result in a separation of members 20 and 22 at one of three predetermined distances 40, 42, and 44, a non-symmetric positioning of members 20 and 22 allows up to nine additional separation distances so that an even greater range of wall widths may be accommodated by device 10.

In accordance with an embodiment of the present invention, device 10 is installed by inserting at least one threaded fastener 28 through member 20 and through at least one bore 32 to couple member 20 to bottom surface 18 of platform 14. Member 22 is aligned with at least two bores 32 so that member 20 is positioned a predetermined distance from member 22. Member 22 is attached bottom surface 18 of platform 14 by inserting threaded fasteners 28 through bores 32 aligned with member 22 and into member 22. Platform 14 is positioned atop wall 12 so that member 20 is proximate a first side of wall 12 and said member 22 is proximate a second side of wall 12.

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. A device for providing a support surface atop a wall, comprising in combination: a platform having a top surface and a bottom surface; a first stabilizing member rigidly attached to the bottom surface of said platform; and a second stabilizing member rigidly attached to the bottom surface of said platform, said first and second stabilizing members attached in parallel spaced relation along a length of said platform and wherein said first stabilizing member and said second stabilizing member constrain a movement of said platform when said platform being positioned atop a wall so that said first stabilizing member is proximate a first side of said wall and said second stabilizing member is proximate a second side of said wall; and a plurality of threaded fasteners, wherein said platform defining a plurality of bores extending between said top surface of said platform and said bottom surface of said platform, each said plurality of threaded fasteners dimensioned to be inserted through each said plurality of bores to couple said first stabilizing member to said platform and to couple said second stabilizing member to said platform so that said first stabilizing member is positioned a first predetermined distance from said second stabilizing member; and wherein at least one of said first stabilizing member and said second stabilizing member comprise a substantially planar portion for contacting a side of said wall.

2. The device of claim 1, wherein said top surface of said platform is substantially planar for providing a flat support surface.

3. The device of claim 1, further comprising a brace attached to said platform and further attached to at least one of said first stabilizing member and said second stabilizing member.

4. The device of claim 1, further comprising: a first brace attached to said first stabilizing member and further attached to said platform by insertion of at least one said threaded fastener through at least one of said plurality of bores; and a second brace attached to said second stabilizing member and further attached to said platform by insertion of at least one said threaded fastener through at least one of said plurality of bores.

5. The device of claim 1, wherein said first predetermined distance is one of approximately 2.75", approximately 7.25", and approximately 9.25".

6. The device of claim 1, wherein said first stabilizing member being attached to said platform by insertion of at least two of said threaded fasteners through at least two said bores and into said first stabilizing member and said second stabilizing member being attached to said platform by insertion of at least two of said threaded fasteners through at least two other said bores and into said second stabilizing member so that said first stabilizing member is positioned a second predetermined distance from said second stabilizing member.

7. The device of claim 6, further comprising: a first brace attached to said first stabilizing member and further attached to said platform by insertion of at least one said threaded fastener through at least one of said plurality of bores; and a second brace attached to said second stabilizing member and further attached to said platform by insertion of at least one said threaded fastener through at least one of said plurality of bores.

8. The device of claim 6, wherein each of said first predetermined distance and said second predetermined distance is a different one of approximately 2.75", approximately 7.25", and approximately 9.25".

9. The device of claim 6, wherein said first stabilizing member being attached to said platform by insertion of at least two of said threaded fasteners through at least two said bores and into said first stabilizing member and said second stabilizing member being attached to said platform by insertion of at least two of said threaded fasteners through at least two other said bores and into said second stabilizing member so that said first stabilizing member is positioned a third predetermined distance from said second stabilizing member.

10. The device of claim 9, further comprising: a first brace attached to said first stabilizing member and further attached to said platform by insertion of at least one said threaded fastener through at least one of said plurality of bores; and a second brace attached to said second stabilizing member and further attached to said platform by insertion of at least one said threaded fastener through at least one of said plurality of bores.

11. The device of claim 9, wherein said first predetermined distance is approximately 2.75", wherein said second predetermined distance is approximately 7.25", and wherein said third predetermined distance is approximately 9.25".

12. A method for providing a support surface atop a wall, comprising the steps of: providing a first stabilizing member; providing a second stabilizing member; providing a plurality of threaded fasteners; providing a platform having a top surface and a bottom surface and defining a plurality of bores extending between said top surface of said platform and said bottom surface of said platform; inserting at least one of said plurality of threaded fasteners through said first stabilizing member and through at least one of said plurality of bores to couple said first stabilizing member to said bottom surface of said platform; aligning said second stabilizing member with at least two of said plurality of bores so that said first stabilizing member being positioned a predetermined distance from said second stabilizing member; attaching said second stabilizing member to said bottom surface of said platform by inserting said threaded fasteners through said bores being aligned with said second stabilizing member and into said second stabilizing member; and positioning said platform atop a wall so that said first stabilizing member being proximate a first side of said wall and said second stabilizing member being proximate a second side of said wall.

13. The method of claim 12, wherein said predetermined distance is one of approximately 2.75", approximately 7.25", and approximately 9.25".

14. The device of claim 12, wherein said first and second stabilizing members are attached in parallel spaced relation along substantially an entire length of said platform.

15. A device for providing a support surface atop a wall, comprising in combination: a platform having a top surface and a bottom surface; a first stabilizing member rigidly attached to the bottom surface of said platform; and a second stabilizing member rigidly attached to the bottom surface of said platform, said first and second stabilizing members attached in parallel spaced relation along a length of said platform and wherein said first stabilizing member and said second stabilizing member constrain a movement of said platform when said platform being positioned atop a wall so that said first stabilizing member is proximate a first side of said wall and said second stabilizing member is proximate a second side of said wall; and a plurality of threaded fasteners, wherein said platform defining a plurality of bores extending between said top surface of said platform and said bottom surface of said platform, each said plurality of threaded fasteners dimensioned to be inserted through, each said plurality of bores to couple said first stabilizing member to said platform and to couple said second stabilizing member to said platform so that said first stabilizing member is positioned a first predetermined distance from said second stabilizing member;

wherein at least one of said first stabilizing member and said second stabilizing member comprise a substantially planar portion for contacting a side of said wall;

wherein said first stabilizing member being attached to said platform by insertion of at least two of said threaded fasteners through at least two said bores and into said first stabilizing member and said second stabilizing member being attached to said platform by insertion of at least two of said threaded fasteners through at least two other said bores and into said second stabilizing member so that said first stabilizing member is positioned a second predetermined distance from said second stabilizing member.

16. The device of claim 15, further comprising: a first brace attached to said first stabilizing member and further attached to said platform by insertion, of at least one said threaded fastener through at least one of said plurality of bores; and a second brace attached to said second stabilizing member and further attached to said platform by insertion of at least one said threaded fastener through at least one of said plurality of bores.

17. The device of claim 15, wherein each of said first predetermined distance and said second predetermined distance is a different one of approximately 2.75", approximately 7.25", and approximately 9.25".

18. The device of claim 15, wherein said first stabilizing member being attached to said platform by insertion of at least two of said threaded fasteners through at least two said bores and into said first stabilizing member and said second stabilizing member being attached to said platform by insertion of at least two of said threaded fasteners through at least two other said bores and into said second stabilizing member so that said first stabilizing member is positioned a third predetermined distance from said second stabilizing member.

19. The device of claim 18, further comprising: a first brace attached to said first stabilizing member and further attached to said platform by insertion of at least one said threaded fastener through at least one of said plurality of bores; and a second brace attached to said second stabilizing member and further attached to said platform by insertion of at least one said threaded fastener through at least one of said plurality of bores.

20. The device of claim 18, wherein said first predetermined distance is approximately 2.75", wherein said second predetermined distance is approximately 7.25", and wherein said third predetermined distance is approximately 9.25".

* * * * *